United States Patent [19]

Turpin et al.

[11] 4,190,757

[45] Feb. 26, 1980

[54] MICROWAVE HEATING PACKAGE AND METHOD

[75] Inventors: Charles H. Turpin; Thomas C. Hoese, both of Minneapolis, Minn.

[73] Assignee: The Pillsbury Company, Minneapolis, Minn.

[21] Appl. No.: 870,906

[22] Filed: Jan. 19, 1978

Related U.S. Application Data

[62] Division of Ser. No. 730,873, Oct. 8, 1976, abandoned.

[51] Int. Cl.[2] ..... H05B 9/06; B65B 25/22

[52] U.S. Cl. ..... 219/10.55 E; 426/107; 426/234; 426/243; 99/451; 126/390

[58] Field of Search ..... 219/10.55 E, 10.55 M, 219/10.55 R; 426/107, 234, 243; 126/390; 99/451, DIG. 1

[56] References Cited

U.S. PATENT DOCUMENTS

| | | | |
|---|---|---|---|
| 1,669,644 | 5/1928 | Andrews | 117/119.6 X |
| 2,501,400 | 3/1950 | Marshall | 426/234 |
| 2,582,174 | 1/1952 | Spencer | 99/221 |
| 2,600,566 | 6/1952 | Moffett, Jr. | 99/221 |
| 2,601,067 | 6/1952 | Spencer | 99/292 |
| 2,714,070 | 7/1955 | Welch | 99/221 |
| 2,759,830 | 8/1956 | Touceda | 126/390 |
| 2,830,162 | 4/1958 | Copson et al. | 219/10.41 |
| 3,070,460 | 12/1962 | Huppke | 117/119.6 |
| 3,218,429 | 11/1965 | Lenart | 219/10.55 |
| 3,219,460 | 11/1965 | Brown | 99/192 |
| 3,271,169 | 9/1966 | Baker et al. | 99/221 |
| 3,302,632 | 2/1967 | Fichtner | 126/390 |
| 3,420,923 | 1/1969 | Ashworth et al. | 264/26 |
| 3,469,053 | 9/1969 | Levinson | 219/10.55 |
| 3,490,580 | 1/1970 | Brumfield et al. | 206/63.2 |
| 3,519,517 | 7/1970 | Dench | 156/380 |
| 3,539,751 | 11/1970 | Levinson | 219/10.55 E |
| 3,547,661 | 12/1970 | Stevenson | 426/243 |
| 3,585,258 | 6/1971 | Levinson | 219/10.55 X |
| 3,701,872 | 10/1972 | Levinson | 219/10.55 E |
| 3,731,037 | 5/1973 | Levinson | 219/10.55 E |
| 3,773,669 | 11/1973 | Yamauchi et al. | 219/10.55 X |
| 3,777,099 | 12/1973 | Levinson | 219/10.55 E |
| 3,783,220 | 1/1974 | Tanizaki | 219/10.55 E |
| 3,835,281 | 9/1974 | Mannix | 219/10.55 E |
| 3,845,266 | 10/1974 | Derby | 219/10.55 E |
| 3,853,612 | 12/1974 | Spanoudis | 117/212 |
| 3,854,023 | 12/1974 | Levinson | 219/10.55 E |
| 3,881,027 | 4/1975 | Levinson | 219/10.55 E |
| 3,922,452 | 11/1975 | Forker, Jr. et al. | 428/35 |
| 3,941,967 | 3/1976 | Sumi et al. | 219/10.55 E |
| 3,965,323 | 6/1976 | Forker, Jr. et al. | 219/10.55 E |
| 3,974,354 | 8/1976 | Long | 219/10.55 R |
| 3,985,990 | 10/1976 | Levinson | 219/10.55 E |
| 3,985,991 | 10/1976 | Levinson | 219/10.55 E |
| 4,013,798 | 3/1977 | Goltsos | 219/10.55 E |
| 4,027,132 | 5/1977 | Levinson | 219/10.55 F |
| 4,081,646 | 3/1978 | Goltsos | 219/10.55 E |
| 4,121,510 | 10/1978 | Frederick | 219/10.55 E X |

FOREIGN PATENT DOCUMENTS

| | | | |
|---|---|---|---|
| 1049019 | 4/1959 | Fed. Rep. of Germany | 219/10.55 E |

OTHER PUBLICATIONS

Kase, 'Microwave Food Applications in Japan: Domestic Microwave Ovens', Journal of Microwave Power, 8(2), 1973.

*Primary Examiner*—B. A. Reynolds
*Assistant Examiner*—Philip H. Leung
*Attorney, Agent, or Firm*—Robert J. Lewis; Mart C. Matthews; Michael D. Ellwein

[57] ABSTRACT

The invention provides a distribution and heating method for foodstuffs and an inexpensive disposable microwave shipping, heating and serving package for food composed of a paperboard carton and a lossy microwave energy absorber which becomes hot when exposed to microwave radiation. The absorber is associated in conductive heat transfer relationship with a food product contained in the package and is usually bonded to a structural supporting sheet such as aluminum foil. The package also includes a shield e.g., a metal foil sheet adapted to reduce by a controlled amount the direct transmission of microwave energy into the food product. The shield may have holes of a selected size to provide a predetermined controlled amount of direct microwave energy to the food product or can be a nonperforated sheet or screen. The absorber heats the adjacent surface of the food by conduction to a sufficiently high temperature to provide searing or browning while controlled microwave exposure heats the inside. The thickness of the absorber is substantially in the range wherein absorber thickness and temperature response are positively correlated.

12 Claims, 10 Drawing Figures

RELATIONSHIP OF OBTAINED SURF. TEMP. TO COMPOSITE THICKNESS

TIME/TEMP. RESPONSE FOR COMPOSITES OF VARYING THICKNESS

MICROWAVE HEATING PACKAGE AND METHOD

This is a division, of application Ser. No. 730,873 filed Oct. 8, 1976, now abandoned.

FIELD OF THE INVENTION

The invention relates to the food packaging and distribution art and more particularly to an improved microwave heating package containing a heat absorber for converting microwave energy to thermal energy and to a method for distributing foodstuffs.

THE PRIOR ART

Heating foods directly i.e. conventionally in a microwave oven, often gives them a soggy character or if the food is a bread product, it sometimes takes on a leathery character quite unlike that of the same product heated in a non-microwave oven. The crust of some products such as pizza pies develop an unusual texture which is either soggy or leathery and is quite unappealing. Thus, while sogginess and texture is a problem in some food products, the inability of an ordinary microwave oven to brown the surface is particularly important in heating of meats, eggs, bread or vegetables such as hash brown, french fried or augraten potatoes. In recent years, ceramic dishes that become hot in a microwave oven have been sold to solve this problem. Such a dish is quite heavy, relatively expensive and must be pre-warmed without food on it for about 2 to 5 minutes. A number of other containers that have been proposed for browning or searing the surface of a food fall into three general categories. The first are those which include an electrically resistive film usually about 0.00001 cm to 0.00002 cm thick applied to the surface of a nonconductor such as a ceramic dish and described, for example in U.S. Pat. Nos. 3,853,612; 3,705,054; 3,922,452 and 3,783,220. Heat is produced because of the $I^2R$ loss (resistive loss). This system is not acceptable for use in the invention primarily because of the bulk weight and cost of the dish and its breakability. Second are microwave energy absorbers formed from a mass or bed of particles that become hot in bulk when exposed to microwave energy. The microwave absorbing substance can be composed of ferrites, carbon particles, etc. Examples are described in U.S. Pat. Nos. 2,582,174; 2,830,162; 3,302,632; 3,773,669; 3,777,099; 3,881,027; 3,701,872 and 3,731,037 and German Pat. No. 1,049,019. These materials are useful components in the present invention. The third category comprises electric conductors such as parallel rods, cups or strips which function to produce an intense fringing electric field pattern that causes surface heating in an adjacent food. Examples are U.S. Pat. Nos. 2,540,036; 3,271,552; 3,591,751; 3,857,009; 3,946,187 and 3,946,188. This system of heating is not used in the present invention.

In the development of the present invention, microwave energy absorbers when used alone were found unsatisfactory for most purposes particularly in conjunction with heating farinaceous foods such as bread products, fruit pies or pizza pies primarily because the microwave energy received directly by the food product from the magnetron or other microwave generator caused the internal temperature of the food product to rise quite rapidly whereas the heat conducted from the microwave absorber was applied more slowly so that by the time the exterior became brown or was seared, the interior was burned, dried, or otherwise overdone. U.S. Pat. No. 3,941,967 describes a microwave cooking vessel or utensil having a body formed from glass, porcelain, and ceramic or synthetic resin such as fluorine-containing resin, polypropylene, or the like. In the vessel is a metal plate beneath which is provided a heating element such as the ferrite ceramic, silicon carbide ceramic or a resistive film. A shield cover formed from a metal sheet or mesh is placed over the food to isolate the microwave radiation from the food and the internal heating of the material to be cooked is set at a suitable level by properly adjusting the leakage of the microwave radiation through the shield cover. While the system described in the patent can be used to provide a balance between internal and external heating, the vessel is expensive costing $20 or more and heavy. Much of the weight and cost of the patented vessel results from the inherent bulk and weight of the heat absorber. It is therefore used as a permanent utensil by the homemaker and is totally unsuited as a container for vending a food product. Moreover the relatively large bulk and mass of the heat absorber causes it to stay very hot, say 500°-600° F. for quite a time after removal from the oven which makes it possible for the fingers to be burned.

By contrast with the prior art, one major goal of the present invention is to find a way to provide an inexpensive and disposable microwave food heating container or package useful for shipping, heating and when desired to hold food as it is being eaten as well as to provide an improved method of distributing and heating foods with microwave energy. Another heater is described in U.S. Pat. No. 3,777,099. Similarly massive, the heat absorber is placed inside an insulator such as sand or concrete with cardboard or ceramic around it. All forms of the invention utilize a heavy slab or plate on which the food is placed. The food is not shielded or enclosed. U.S. Pat. No. 3,731,037 describes a microwave kiln for food having heat insulating walls preferably of a material capable of withstanding refractory temperatures lined with a material such as glass or ceramic which is made lossy. The patent also discloses a disposable kiln containing an aluminum food dish, polyurethane foam walls and a lossy floor lining which consists of water.

It has been previously proposed to provide a paper box with a metal foil layer which partially shields a food contained in the package from microwave radiation when heated in a microwave oven. Examples are U.S. Pat. Nos. 2,714,070; 3,865,301 and 3,219,460. When foods are heated in packages of this kind, the aforementioned problems of sogginess or leatheriness and absence of surface scorching occur rendering the container unsuited for the purpose to which the present invention is directed.

OBJECTS OF THE INVENTION

The major object is to provide a microwave heating package and distribution method for foodstuffs having the following characteristics and advantages among others: (a) the package can be considered inexpensive and disposable, (b) can be used for both shipping and heating a food and will sear or brown its surface, (c) can be used as a serving plate or tray, (d) can be constructed primarily of known packaging materials which are readily obtainable and inexpensive, (e) provision is made for locating a heat absorber in position to receive microwave energy at a point in the oven where the energy is coupled efficiently to the absorber, (f) the food can in some forms of the invention be heated simultaneously by the dual application of microwave energy directly and by conduction heating from a heat absorber to the surface of the food product to thereby brown, dry or scorch the surface in contact with the heat absorber, (g) the package is safe to use without danger of sparks, arcing or burning during heating, (h) provision is made if desired for totally shielding the food product from direct exposure to microwave energy while heating is accomplished solely through conduction from a heat absorber, (i) there is a provision for allowing the heat absorber to very quickly cool after it is turned off to prevent burning the fingers, (j) the package has enough strength to adequately protect the food during shipping and will not break or contaminate the food, (k) the package is light weight and specifically, a package for a single $3\frac{3}{4}\times3\frac{3}{4}$ inch 66 gm. slice of pizza will weigh about 30 gm. or less and contain a microwave absorptive heating material in a layer weighing about 15 gms. or less.

THE FIGURES

SUMMARY OF THE INVENTION

Figure 1:
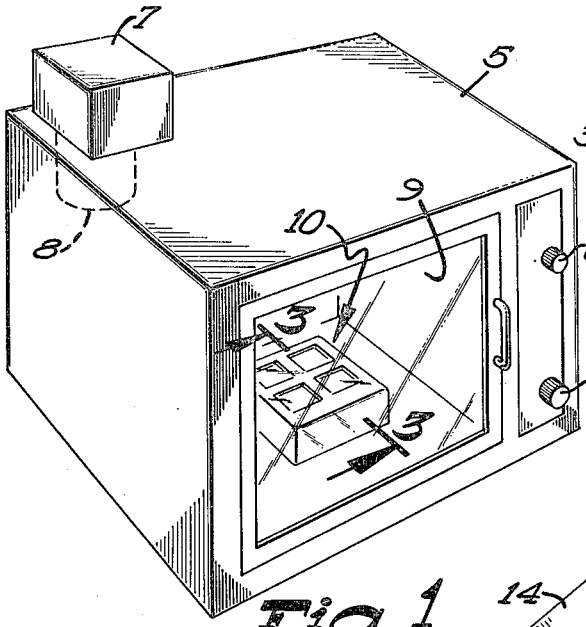
FIG. 1 is a perspective view of a microwave oven containing a package embodying the invention.

The invention provides an inexpensive disposable microwave food shipping, heating and serving container or package composed of a lossy microwave energy absorber or heating body which becomes hot when exposed to microwave radiation associated in conductive heat transfer relationship with a food product when the food is placed in the package. The expression heat conductive relationship herein means thermal conduction through a solid as well as the transmission of radiant heat by electromagnetic waves and the convection of heat through the air. Thus although the food usually touches the absorber or is in contact with a layer adjacent to it, contact is not always essential. The food while usually refrigerated can be frozen or at room temperature. The absorber or heating body is usually but not necessarily a layer or sheet of lossy material bonded to a structural supporting sheet such as metal foil. The package preferably includes a shield which is usually an electrical conductor to reduce by a controlled amount the direct transmission of microwave energy into the food product. The shield can comprise a metal screen or a metal foil cover having holes adjusted in size to provide a predetermined and controlled amount of direct microwave energy transmission into the food product or when required a single nonperforated sheet. In some embodiments of the invention parts of the package are enclosed and supported in an outer container body formed from microwave transparent semi-rigid dielectric sheet material such as a paperboard carton which forms a part of the package. The absorber heats the adjacent surface of the food by conduction to a sufficiently high temperature to crisp or scorch the surface while direct microwave exposure of the food when provided heats the inside. It is preferred that the thickness of the heating body be substantially in the range wherein absorber thickness and temperature response are positively correlated. In one preferred form of the invention the microwave absorber layer is of the minimum thickeness that will reach without exceeding a preselected equilibrium operating temperature.

The invention also provides an improved method of distributing and heating foodstuffs by packing them in a disposable container having a shield and absorber for converting microwave energy to thermal energy then transporting and heating them in the container to provide surface scorching and reduced direct microwave transmission to the food as will be described more fully below.

Packages in accordance with the present invention can be used for shipping and vending foods both through retail grocery outlets and vending machines. They can be used for a single serving or for several foods in a single container in the manner of a T.V. dinner.

The container body can comprise any microwave permeable nonlossy material and is usually a dielectric such as paperboard or other cellulosic material or plastic resin such as a polyamide or polyester resin having the requisite heat resistance. The container body, e.g., a paperboard box usually includes side, top and bottom walls to enclose and protect the food product.

The lossy microwave energy absorber preferably has the form of a thin sheet or layer that serves as a heating body and is usually part of a composite sheet of heating body composed of a structural supporting sheet that can be either microwabve transparent or microwave opaque such as a ceramic or metal sheet to which the active microwave absorber is applied as a relatively thin paint like layer. The expression paint like layer herein means a coating applied as a layer having a small finite thickness up to on the order of about 1/32 of an inch bonded directly to the structural support layer and having a sufficient flexibility to remain adhered to the layer when the lartter is bent or deformed. When this laminate is used to support the food product, the energy absorbing layer is normally placed on the opposite side of the structural support sheet from the food thus the food is adjacent to and usually contacts the structural support sheet or foil. The geometry and especially the thickness of the microwave absorber is preferably maintained within a specified range to control the saturation i.e., equilibrium temperature reached by the heater after a specified period of heating or indefinite heating. It was discovered that the thickness should be maintained substantially within the range wherein the temperature is positively correlated with the changes in thickness i.e., the temperature response rises with an increase in thickness. The shield which reduces by a controlled amount the quantity of direct microwave transmission to the food product is conveniently applied as a layer or lamination to the inner surface of the container body. It is preferably, but not invariably, formed from an electrically conductive material such as metal foil, e.g., aluminum foil.

One or more microwave absorbent heaters can be employed. For example, if two are employed, it is convenient to place one on the top and one on the bottom of the food product to sear or brown both top and bottom surfaces. The invention also contemplates completely surrounding the food product with a microwave absorbent heater. This form of the invention is particularly useful in connection with fruit pies.

In the accomplishment of the foregoing and related advantages and objectives, this invention then comprises the features hereinafter fully described and partially pointed out in the claims, the following description setting forth in detail certain illustrative embodiments of the invention these being indicative, however, of but a few of the various ways in which the principles of the invention may be employed.

DETAILED DESCRIPTION

Figure 2:
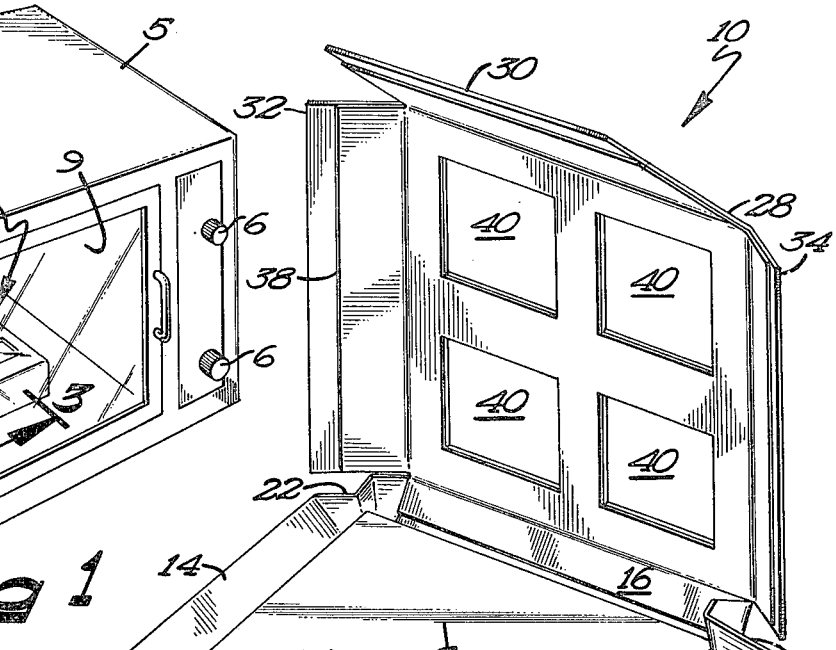
FIG. 2 is a perspective view of the package of FIG. 1 on an enlarged scale shown with the top open.
Figure 4:
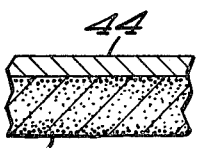
FIG. 4 is a greatly magnified partial sectional view taken on line 4—4 of FIG. 2.
Figure 3:
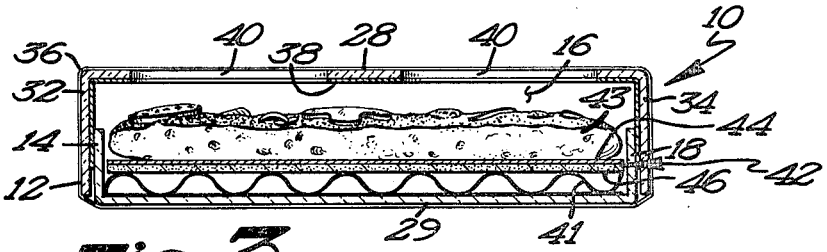
FIG. 3 is a vertical transverse sectional view taken on line 3—3 of FIG. 1 with the package in a closed condition.

Refer particularly to FIGS. 1, 2 and 3 which illustrates a typical application of the invention for use in shipping, heating and serving a single portion of a food such as a slice of pizza pie.

FIG. 1 illustrates a package embodying the invention in a microwave oven 5 of suitable known construction including the usual control 6 microwave generator 7 producing microwaves under present regulations at 2450 megahertz. It is to be understood, however, that the present invention is applicable to all wavelengths at which microwaves can be used for heating. Microwaves are usually understood to be in the range of 1000 to 30,000 MHZ. The waves are conducted through guide 8 to a microwave oven cavity 9 into which the package 10 is placed.

The package 10 comprises an outer container body 12 formed from a microwave transparent nonlossy material such as a dielectric sheet material, e.g. paperboard or plastic including four sidewalls 14, 16, 18 and 20 joined by centrally extending integral corner folds 22, 24, 26 and 27 each comprising a pair of mutually hinged flaps that are also hinged along one side edge to an adjacent sidewall. The carton 12 also includes integral bottom wall 29 and top wall 28 having a tab 30 that can be secured in any suitable manner, e.g., by pasting to the sidewall 20 when the carton is closed to hold the top in place. The top 28 also includes a pair of side flaps 32 and 34 which fold downwardly and lie adjacent to the outside surfaces of side walls 14 and 18. The carton when used for a single serving of pizza pie might measure 4×4×1 inch. If paperborad is used, 14 to 18 point bleached food grade sulfate paperborad is preferred. The package is wrapped with cellophane or other protective flexible sheet material 36 (FIG. 3) including any of the well known packaging films such as nylon, polyester, polystyrene, wax paper, etc. the wrapper 36 is used to protect the package during storage and is removed prior to placing the package in the microwave oven.

Bonded to the inside surface of the cover flap 28 is a shield composed of an electrically conductive metal foil 38 comprising 0.00035 inch aluminum foil laminated to 25 pound kraft paper. This laminate is bonded with any suitable adhesive to the inside surface of cover 28. The shield 38 in this case does not totaly shield the food product contained in the package from all microwave radiation but instead acts as a partial shield adapted to control the passage of microwave energy into the food product directly. The amount reaching the food directly is less than the amount that would reach it without the shield. Transmission is accomplished through openings 40 of a predetermined size. As heating occurs, moisture vapor and steam is vented through the openings 40 thereby maximizing the opportunity for moisture to be driven out of the crust and for the crust to become crisp. If desired, one or more moveable metal covers (not shown) can be provided to open or close the openings 40 prior to heating to any desired extent to thereby allow the user to control the amount of internal heating. Good results have been achieved with pizza pie of 66 gm. in a 1000 watt oven with four openings 40 each 1¼ square inches, i.e., totaling 5 square inches of open area while the total area of the shield 38 (including the hole area) is about 21 square inches. Thus, the open area of the holes 40 is about 25% of the shielded area, however, good results can be achieved with a much wider range of open area for example about 10% to 75% of the shield can be open when direct microwave heating is desired. In some cases, as described below, no direct microwave heating is provided for the food product, the product in that case is heated solely by conduction from the heat absorber. In determining the size of the openings 40, i.e., the degree of shielding, one first decides upon the amount of conduction or surface heating that is needed and establishes that the dimensions and composition of the composite 42. The size of the openings 40 (or in the case of other embodiments such as that in FIG. 8 where no holes are used the size of the shield itself) is then made larger or smaller until the desired predetermined amount of internal heating is accomplished by direct microwave transmission without burning or drying the interior. This is best accomplished empirically. Thus, if the product is not warm enough on the inside, the openings 40 are made larger but if too warm or burned, the openings 40 are made smaller. In general, the size of openings 40 or the size of the shield itself if no holes are used will be determined by the type of food, its composition, the amount of water contained in the food, whether it is frozen, cooked or uncooked, etc. It should be understood that as the amount of direct microwave transmission to the food is increased, for example by making the openings 40 larger, the amount of energy going to the absorber and consequently the amount of conductive heating decreases. The dimensions and opening size given are merely set forth by way of example.

Within the carton described is provided a spacer such as a sheet of open faced corrugated board or other suitable microwave transparent material 41 of just the proper size to fit easily in the bottom of the carton. On this spacer rests a heating body 42. The heating body 42 is a composite or laminate best seen in FIGS. 2 and 3 consisting of an upper structural support number 44 having a substantial degree of strength and the heat resistance necessary to withstand the temperature involved, e.g., aluminum, steel, copper, brass or ceramic foil or sheet mica, portland cement, or plaster of paris being typical and a heating layer 46 which comprises any suitable microwave absorptive lossy substance known to the art that will reach a temperature when exposed to microwave energy above 212° F. either alone or in combination with one or more diluents and binders. It is important to note that the body 42 is flexible or semi-flexible in that it can be easily formed or bent with the fingers without fracturing into pieces although coating 46 may crack. This flexibility gives it resistance to breakage even though struck with a hard blow as contrasted with the performance of a rigid sheet formed from a brittle material.

The layer 46 is relatively thin like a layer of paint. The binder bonds or cements the absorbent particles together to hold them in place and also forms the heating layer 46 into a solid mass thereby preventing sparks or arcing between individual particles. The bonding function can be provided by any suitable adhesive or solid matrix that is resistant to the temperatures involved such as portland cement, plaster of paris, sodium slicate, etc. The layer 46 may not be continuous. This is to say, it can be provided in two or more strips or bands or may include holes or openings. The microwave absorber should preferably be lossy enough to achieve temperatures of over 300° F., the most preferred being in the range of 400° F. to 800° F. Any known lossy microwave energy absorbing substance can be used if it is capable of achieving a temperature of over 212° F. to thereby bring to a boil any free moisture present in the food. The microwave absorbing material may or may not be of the type which is variable with a temperature as described in U.S. Pat. No. 2,830,162.

Any suitable lossy substance that will heat in bulk (as distinguished from a resistive film) to more than 212° F. in a microwave oven can be used as the active heating ingredient of the microwave energy absorbent layer 46. These materials falls primarily into four groups: first semiconductors, examples of which are zinc oxide, germanium oxide, barium titanate, etc. Among the second group are ferromagnetic materials that have a Curie temperature higher than about 212° F. including powdered iron, some iron oxides, and ferrites such as barium ferrite, zinc ferrite, magnesium ferrite, copper ferrite, or any of the other commonly used ferrites and other suitable ferromagnetic materials and alloys such as alloys of manganese, tin and copper or mangenese, aluminum and copper and alloys of iron and sulfur such as pyrrhotite with hexagonal crystals, etc. Other materials include silicone carbide, iron carbide, strontium ferrite and the like. Other suitable materials include period 8 oxides and other oxides such as cromium oxide, cobalt oxide, manganese oxide, samarium oxide, nickel oxide, etc. One preferred material is powdered and granular $Fe_3O_4$ obtained from taconite or mixtures of powdered and granular $Fe_3O_4$. In a fourth group are dielectric materials such as asbestos, some fire brick, carbon and graphite.

With regard to ferroelectric and ferromagnetic materials it has been found that generally the Curie point must be the same or above the maximum temperature one wants to achieve. Thus, if 500° F. is the desired temperature, the Curie point must be at least 500° F. Slightly higher temperatures might be achieved if the dielectric absorption gives rise to further temperature increases. Relatively high magnetic or dielectric constants improve the heating ability of the material and help to achieve thinness in the finished product by reducing the mass of material required to achieve a given temperature. The final temperature achieved is limited in three ways in general. First by the Curie point of the active heating material, because below the Curie point the material absorbs microwave energy and above this temperature the material loses its magnetic properties and will no longer heat. Second by the percentage of active microwave absorbent material in the mixture and third, by the amount or mass of microwave absorbent material and particularly by the thickness of the layer 46 that is used. Clay ceramic which while not extremely lossy alone, if made part of the heater layer 46 will contribute to some extent to the heat produced. Other examples are silicates and like glasses.

The structural support layer 44 should be relatively inexpensive, undamaged by heat, corrosion resistant nontoxic to food and provide a degree of structural strength. When aluminum is employed it is preferably a foil about 1-3 mil. thick. The absorber is preferably on the outside, that is to say, on the opposite side of the supporting sheet 44 from the food product. Aluminum foil when inside serves two purposes. It is a structural support for the absorber and also acts as a clean cooking surface to prevent contamination of the food product by the absorber. While metal is preferred, layer 44 can also comprise a nonmetal such as a nonmetalic mineral or a thin glaze of ceramic fused to the upper surface of the heat absorbing layer 46 but because the heating body 42 must withstand temperaures of 500° C. to 600° C. such a structure does not have the strength of a composite using a metal layer and is expensive in addition to being more breakable. If the structural support 44 is nonmetalic it is preferred to use a temperature resistant mineral or ceramic which is fused to form a homogeneous sheet either with or without reinforcement such as a metal screen, metal or mineral fibers, glass fibers, etc. for structural strength. Metals are greatly preferred to ceramics and glass because of their relative toughness, flexibility or bendability and resistance to breakage. Accordingly, less material is required than in the case when a nonmetal is used for the structural support 44. A fourth group comprised formulated combinations of the above materials, or the above materials mixed with nonlossy microwave permeable materials such as minerals including perlite, sand, alumina, magnesia or the like which function as inert fillers to slow down the heating rate and help make the layer stronger.

The best lossy material to use depends upon a number of factors, the most important of which are its heating efficiency, the final temperature to be achieved, the heat stability or resistance to cracking or other destructive factors, the lack of sparks, arcing, etc. When $Fe_3O_4$ is used as the primary lossy heat absorber, one suitable formula is 37 grams $Fe_3O_4$ obtained from taconite, 37 grams sand and 11.5 mil. of a 2.5 part sodium silicate to 1 part water solution. The sand and powdered $Fe_3O_4$ are blended together and the sodium silicate solution is added and uniformly mixed. This wet mixture is applied by brushing, rolling, etc. onto a sheet of 3 mil. aluminum to a thickness of 0.030 inches. The laminate comprising the layers 44 and 46 is then heated with the edges held to prevent warpage to about 200° F. for about 2 hours or until dry. The resulting laminate is very light in weight, flexible in the sense that it can be easily bent with the fingers, stable and strong enough to withstand shipment and storage. It is nontoxic to food substances and will heat the surface of the food in contact with the upper surface of the aluminum foil to 600° F. or hotter. During the drying of the coating layer 46, most of the water is lost so that the final dry composition comprises about 37 grams $Fe_3O_4$, 37 grams sand and about 5 grams sodium silicate.

The spacer 41 can be formed from many microwave transparent articles of which open face corrugated board is merely an example. Other suitable materials are one or more pieces of perlite, magnesia alumina, glass, fiberglass, etc. If perlite is used, it can be formed from powdered perlite bonded together with sodium silicate in a manner known to those skilled in the art. The spacer 41 preferably holds the absorber 42 about a quarter of an inch or more from the lower surface of the oven cavity to promote efficient coupling of the microwave energy to the heat absorber.

Resting upon the heating body 42 is a food product 43 such as a square slice of pizza or any of a variety of other foods including french fries, hash brown potatoes, onion rings, cheese sandwich to be toasted, a slice of fruit pie, meat, etc. While convenient to make contact between the food and the laminate 44–46, it is not essential since heat can be transferred from the composite sheet to the food by radiation or convection rather than conduction.

The food is placed in the package 10 at the factory and shipped at any temperature either frozen or non frozen and can be placed in the oven 5 in either a frozen or non frozen condition. When the food is to be heated, the wrapper 36 is removed thereby uncovering the openings 40. The package is then placed in the microwave oven and as microwave energy passes into the chamber 9 through guide 8 a predetermined controlled amount of the microwave energy enters the package through openings 40 and passes directly into the food product 43 heating it throughout. The remainder heats the absorber 46 and is transmitted by conduction through aluminum foil layer 44 to the bottom of the food product thereby crisping or browning the bottom of the crust. This action has proved to be highly effective in removing the soggy or leathery character found when the same food product is heated alone in a microwave oven. Heating in a 1000 watt oven will take about 105 seconds for a 66 gm. pizza and 180 seconds for a 264 gm. pizza. The direct controlled microwave transmission through the openings 40 allows sthe interior of the food product to be heated without being burned or dried. The heat absorber reaches a temperature typically of about 500° F. to 700° F., and preferably in the range of 600° F. Because of the relatively small amount of material in the heat absorbing layer 46 and the low cost of component parts, the container is very inexpensive and can be considered disposable. In addition, the low mass of the heater allows it to very quickly cool to the same temperature as the food product 43 when the power is turned off thereby minimizing the risk of burning the fingers. The microwave absorptive heating surface is characterized by providing sufficient heat to roast, sear or toast the surface of the food article without burning either other parts of the package or the hands when the package is opened.

The geometry and especially the thickness of the heating body 42 and layer 46 was discovered to be an important factor in successfully utilizing the present invention. In the development of the present invention, it was discovered that as the thickness of the heater layer 46 was increased starting from a small finite thickness typically in the range of 0.01 inch to 0.016 inch thereby increasing the thickness of the heating body 42, the final temperature after a given period of heating rises at first, in other words, is positively correlated with changes in thickness but it then falls surprisingly after some critical thickness is reached and is negatively correlated with the thickness of the heating layer.

Figure 9:
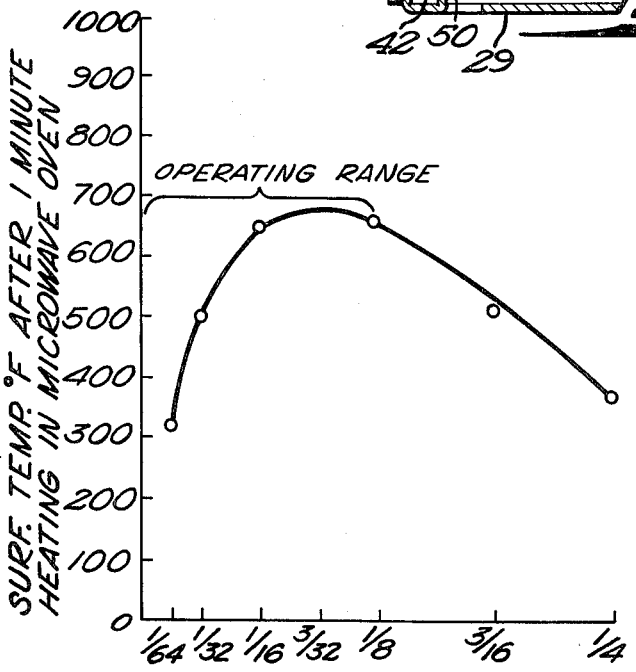
FIG. 9 is a graph illustrating the relationship between the composite absorber thickness and the resulting surface temperature after heating for one minute.
Figure 10:
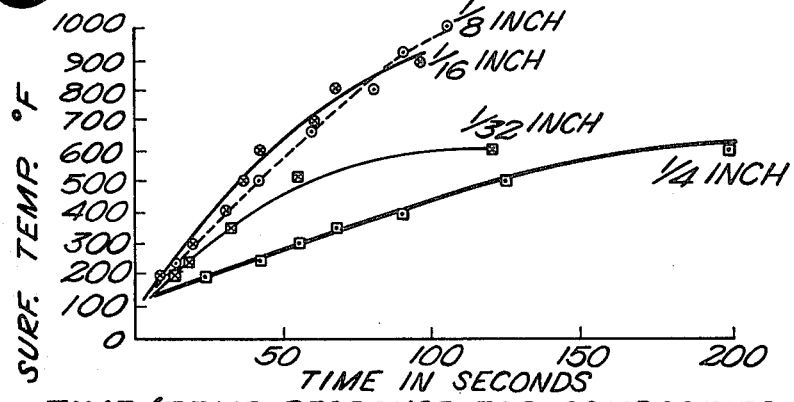
FIG. 10 is a graph showing the time/temperature response for absorbers of different thicknesses.

Refer to FIG. 9 which clearly shows the correlation by plotting the thickness of heating body 42, that is, of aluminum layer 44 and the lossy heating layer 46 against the surface temperature after one minute of heating in a microwave oven. The layer 46 in both FIGS. 9 and 10 consisted of 50% - 325 mesh $Fe_3O_4$ and 50% - 30 + 325 mesh $Fe_3O_4$ uniformly mixed together and bonded as a solid paint like layer to a 3 mil. sheet of aluminum with a binder consisting of a sodium silicate solution (2.5 parts sodium silicate to 1 part water) with 11.5 mil. of the sodium silicate solution added for each 74 grams of iron oxide. The heating experiments illustrated in FIGS. 9 and 10 were carried out in a 1000 watt Litton 70/30 oven. The particle sizes presented herein are expressed as U.S. screen sizes. All quantities and proportions herein are expressed by weight rather than volume unless so indicated. The strongest specimens, i.e., those that withstand heating best without cracking or other damage contain particles of different sizes. For that reason the materials of more than one particle size are preferred.

The preferred thickness of the heating body whether a composite sheet or a microwave absorptive heating body that is not a composite is substantially on the rising temperature response portion of the curve of FIG. 9, in other words, from a small finite thickness at the left so substantially the maximum temperature response. It is in the general range that the temperature increases as a function of increasing thickness, i.e., is positively correlated. The word "substantially" herein means no more than $\frac{1}{3}$ greater than the thickness producing the maximum temperature response. Thus, in FIG. 9 for example, the operative range extends from the low end of the curve at the left upwardly to 3/32 inches, the maximum response, plus $\frac{1}{3}$ of 3/32 inches or $\frac{1}{8}$ of an inch. By using thicknesses in this range, the following advantages are achieved. First, the mass of the heater and its cost is kept as low as possible. Second, the composite 42 tends to be more flexible and is more resistant to breakage because layer 46 is better supported by the layer 44. Third, it cools almost immediately to the temperature of the food when removed from the oven thereby minimizing the opportunity to burn the fingers and finally, it heats the surface of the food at a faster rate. This can be seen best by comparing the slopes of the curves in FIG. 10 wherein heating time in the oven is plotted against the temperature at four different thicknesses of composite 42.

An important feature of the invention is the discovery that it is useful to control the final equilibrium temperature of the heater, i.e., prevent it from exceeding a predetermined maximum temperature by limiting the thickness of the coating 46. Thus, it can be seen that by reference to FIG. 10 that laminates of $\frac{1}{8}$ and 1/16 inch thickness can reach 800° F. or 900° F. However, by limiting the thickness to 1/32 of an inch, a maximum of 600° F. will be reached. In a preferred form of the invention, the thickness of the heat absorbing sheet is the minimum thickness that will reach, but not exceed, a selected equilibrium temperature. However, if the temperature of the absorber is still rising at the point where the oven is turned off and the food is done, this preferred optional form of the invention is not being used. While this feature is peferred, it is not essential since turning off the oven at exactly the correct time will prevent overheating. However, it is not as safe and reliable.

Figure 5:
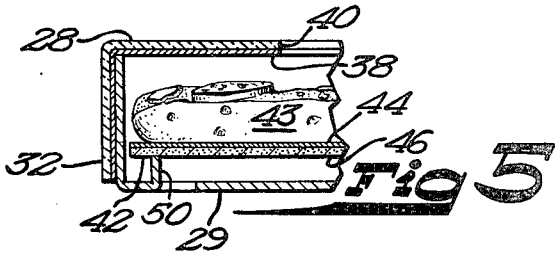
FIG. 5 is a partial vertical sectional view similar to FIG. 3 of a modified form of the invention.

Refer now to FIG. 5 which illustrates a modified form of the invention in which the same numbers refer to corresponding parts already illustrated in FIGS. 1 to 4. As seen in FIG. 5, the spacer 41 is not used. In its place are a plurality of supports 50 in this case four in number (only one being shown) each of which consists of a tab or flap made by placing a semi-circular cut in the bottom wall 29 of the box 10 near each of the corners thereof. Each of the resulting tabs is turned up thereby supporting the corners of the heating plate 42 and the food product 43. The package of FIG. 5 is less expensive than FIGS. 1 to 4 since the corrugated material 41 is eliminated.

Figure 6:
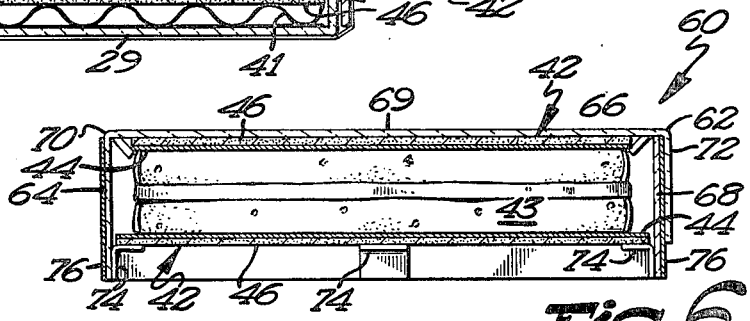
FIG. 6 is a vertical sectional view of another form of the invention.

FIG. 6 illustrates another modified form of the invention. A microwave food heating package 60 includes an outer container body 62 in this case the carton formed from paperboard having four vertically disposed rectangular sidewalls only three which 64, 66 and 68 are shown all connected together at their edges either with or without inwardly projecting cornerfolds as described above in connection with FIGS. 1 to 4. Hinged at 70 to the upper edge of wall 64 is a top wall 69 having a tab 72 that is glued down to hold the cover in place prior to opening. In the package of FIG. 6 are two parallel vertically spaced heating composites or laminates 42 each similar to that already described in connection with FIG. 4. If desired the upper composite 42 can contain a more concentrated absorber in layer 46 or be thicker so as to reach about the same temperature as the lower composite in the slightly less concentrated field found at the top of the package. One laminate is placed below the food 43 with the aluminum layer 44 facing upwardly in contact with the lower surface of the food and the other is placed above the food and resting on top of the food product with the aluminum layer 44 facing downwardly in contact with the upper surface of the food. The lower laminate 42 can be supported in any suitable manner as by means of paperboard tabs 74 which extend inwardly from sidewalls 64 and 68. It will be seen that the walls 64 and 68 extend downwardly slightly beyond the laminate 42 thereby supporing composite 42 a predetermined distance, e.g., ¼ inch above the floor of the oven chamber during heating. Bonded to the outside surface of each sidewall including walls 64–68 is a shield comprising a strip of electrically conductive material such as an aluminum foil strip 76 which extends all the way around the carton thereby surrounding the food product 43. Strip 76 together with the laminates 42, totally shields the food product from all direct microwave energy radiation so that heating in this instance is carried out solely by means of conduction from the composite 42. In this case the lower composite 42 serves as the bottom of the container. The food product in this instance comprises any kind of food which normally is cooked very little on the interior or has been precooked so that only exterior scorching or browning is needed. Examples are a raw egg, a grilled cheese sandwich consisting of two layers of bread between which is placed a layer of cheese or a bacon, lettuce and tomato sandwich, etc. If the food product comprises a raw egg, the egg can be surrounded by a ring or strip of paper (not shown) or other material to prevent the albumen of the egg from spreading. When these foods are cooked in such a package, the benefits are surprising. In the case of a bacon, lettuce and tomato sandwich, the outside of the bread is toasted and hot whereas the lettuce and tomato remains fresh and crisp and does not become cooked, wilted or slimey as it would if placed alone in a microwave oven and cooked. In the case of a grilled cheese sandwich, the bread is toasted and the cheese is warmed or slightly melted whereas if heated alone the cheese will become extremely hot and the bread soggy. A raw egg can be fried using the package of FIG. 6 and it has the characteristics of an ordinary fried egg whereas when cooked in a microwave oven alone, the finished product is somewhat like a poached egg. If desired, the foil strip 76 can be omitted to permit the entry of a controlled amount of microwave energy into the food to heat the interior in addition to the surface heating provided by the two composite sheets 42. This modification is useful with a variety of foods such as batter coated precooked filet of fish and hash brown potatoes, etc.

Figure 7:
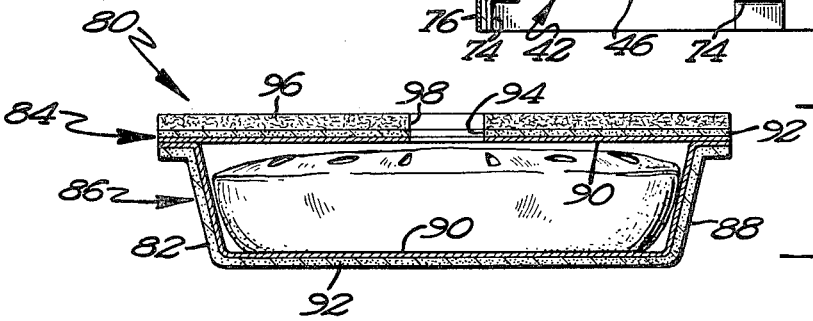
FIG. 7 is a vertical sectional view of another modified form of the invention.

FIG. 7 illustrates another form of the invention in which a shipping, heating and serving package 80, particularly well suited for heating fruit pies, comprises a container body 82 having an upper wall or cover 84 and a lower wall in the form of a tray or pan 86. Both cover 84 and pan 86 are made from any of the materials already described concerning the composite 42 except that the structural support layer 44 must be an electrically conductive metal foil or sheet. Thus, the pan portion 86 comprises a truncated conical sidewall 88 and integral bottom wall 90 both of which are formed from 1 mil. aluminum foil to which is bonded a 1/32 inch thick layer of a lossy microwave absorptive heating composition 92 on its outside surface that can be the same as any of those described above in connection with FIGS. 1–4 and 9 and 10. The cover 84 is made of the same laminate as pan 86. It includes a metal foil layer 91 and heating composition applied as a coating or layer 93. The cover 84 has a hole 94 an inch or so in diameter to allow for the introduction of a predetermined controlled amount of microwave energy for direct heating of the food. Bonded to the top of the cover 84 is a fibrous insulating layer 96 provided with an opening 98 in alignment with the opening 94 to permit the introduction of microwave energy into the food product and the escape of moisture vapor during cooking. The insulating layer 96 can comprise any suitable insulating material known to the art such as a mineral insulating material including alumina, perlite, magnesia with or without reinforcing fibers such as glass or asbestos fibers and the like. It can be seen that the metal foil layers 90 and 91 totally shield the food from microwave energy except that which enters through opening 94 as well as acting as a support for layers 92 ad 93 respectively.

Thus, the package 80 is used by placing the pie such as an apple, cherry or blueberry pie in the pan 82 at the factory, crimping the cover 84 in place and applying the insulating layer 96. The pie is then shipped in either a frozen or refrigerated state and if frozen can be thawed either conventionally or as the first stage of heating in microwave oven 5. Heating to serving temperature is carried out by placing the package in a microwave oven and turning on the oven until the pie has reached the proper temperature. In a 1000 watt oven this will usually take about 5 minutes from the frozen state. As contrasted with a pie heated alone in a microwave oven, the package 80 will effectively heat the fruit filling primarily as a result of the direct microwave heating due to energy passing in through opening 94 while the microwave absorbing pan and cover will crisp the crust portion of the pie to give it an appealing taste and texture that is much more appealing than the soggy texture of a pie heated alone in a microwave oven. Cooking in a non-microwave oven takes about 45 minutes. The insulator 96 was found useful in preventing the loss of heat from the top during and immediately after cooking. As in other forms of the invention, the container 80 is very inexpensive and can be considered disposable. Moreover, it functions for transporting the food product for heating it and if desired for serving the food product.

Figure 8:
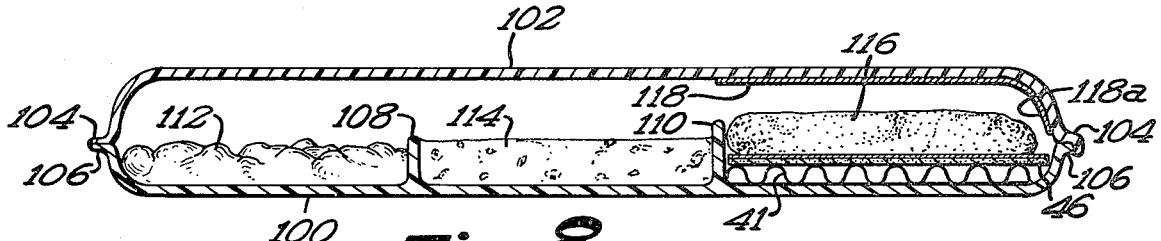
FIG. 8 is another form of the invention in vertical cross section.

Refer now to FIG. 8 which illustrates a modified form of the invention to be used in shipping, heating and serving of several foods only one of which is to be heated on the surface in accordance with the present invention. As seen in FIG. 8 a tray 100 and cover 102 are provided each of which may be generally rectangular in plan view with mating edges 104 and 106 that hold the cover 102 in place before the food is served. The tray 100 is divided into three compartments containing foods 112, 114 and 116 by transverse ribs 108 and 110. Food products 112 and 114 can comprise foods that should be heated uniformly throughout such as diced carrots and mash potatoes. The food product 116 is any of the kinds mentioned above which should be heated on the surface to a very high temperature. The heating composite 42 can be of any of the compositions described hereinabove. It includes a structural supporting layer 44 facing upwardly against the food 116 and a microwave absorptive heating layer 46 bonded to layer 44 as already described. The composite 42 is supported upon a spacer 41 also as described above. Laminated by means of a suitable adhesive to the inside surface of the cover is a shield 118 formed from an electrical conductor which in this instance comprises a sheet of woven metal screen such as aluminum screen of a predetermined size including a horizontal top portion and side portion 118*a* that extends downwardly somewhat to provide the requisite shielding for the food product 116. A certain amount of microwave energy will be able to reach the food product 116 from the sides. Thus, only partial and not complete shielding is provided. The amount of energy reaching the food product 116 and hence the size of the shield 118 is determined by the inside temperature reached when the requisite degree of surface crisping or browning is accomplished by the heater composite 42. The tray 100 and cover 102 can comprise any suitable dielectric material such as pressed paper, paper fiber or plastic resin with the requisite heat resistance and can be either foamed or non-foamed. The same materials can be used as described in connection with the carton 12. During use, the tray and cover are placed in a microwave oven which heats the foods 112 and 114 by direct microwave transmisson and food 116 both by controlled direct transmission and by conduction from the composite 42. The food can be served and eaten in tray 100 after the cover 102 has been removed.

It can thus be seen that the invention is adapted to providing a heater composite for heating by conduction to one or more surfaces of a food while the food is shielded at least in part from microwave energy. Specifically, in one form of the invention conduction heating is provided on the bottom and the top is shielded. In another embodiment, conduction heating is provided on the top and bottom while the side is either shielded or not shielded. In other cases the product is totally shielded from all direct exposure to microwave energy as illustrated in FIG. 6 with heating carried out solely by conduction. However, in any case the conduction heating browns, crisps or sears the surface of the product or dries it out to such an extent as to remove the sogginess or leathery character associated with such a product when heated alone in a microwave oven. It can also be seen that the present invention as illustrated in all embodiments except FIG. 6 will provide simultaneously direct microwave and thermal heating in balanced predetermined proportions.

It can also be seen that the invention provides a package which is so inexpensive and light in weight that it can be considered disposable and will afford excellent protection for a food product during shipment, storage and can even be used as a serving dish. Moreover, because of the lightness of the microwave absorbent lossy heat composite, the composite will heat at a very rapid rate and cool down quickly thereby making the package safe to handle after removal from the oven.

The temperatures reached after one minute of heating of various absorptive compositions are presented below in Table 1. The tests were run on a 1000 watt Litton 70/30 oven. Samples were made with the composition listed to provide a complete laminate of the thickness given by applying the wet coating to a 1 mil. thick sheet of aluminum measuring 4 inches by 4 inches. The coating was then dried in an oven for an hour at 250° F. The laminate was then placed in an oven and heated without any food product in contact with it during the test.

TABLE 1

HEATING RANGE OF VARIOUS BONDED COMPOSITES

| Example | Weight, Grams | Nominal Thickness, Inches | Surface Temperature in 60 Sec. °F. - Range | Constituents, wt. % Other than Binder | Binder |
|---|---|---|---|---|---|
| 1 | 74 | 1/8 | 500–600 | Q Ferrite* (100) | Sodium silicate |
| 2 | 75 | 1/8 | 450–550 | Q Ferrite* (100) | Sodium silicate |
| 3 | 70 | 1/8 | 500–600 | −325 $Fe_3O_4$ (100) | Sodium silicate |
| 4 | — | 1/16 | 550–750 | −325 $Fe_3O_4$ (100) | Calcium aluminate |
| 5 | 112.3 | 1/8 | 400–500 | −325 $Fe_3O_4$ (40), −28 Fe (60) | Sodium silicate |
| 6 | 95 | 1/8 | 600–800 | −325 $Fe_3O_4$ (50), −30 + 325 $Fe_3O_4$ (50) | Sodium silicate |
| 7 | 61.1 | 1/8 | 400–600 | −325 $Fe_3O_4$ (72), −30 + 325 Graphite (28) | Sodium silicate |
| 8 | 90 | 1/8 | 400–700 | −325 $Fe_3O_4$ (37.5), −30 + 325 $Fe_3O_4$ (37.5), −325 Silica (12.5), −20 + 100 Sand (12.5) | Sodium silicate |
| 9 | 80 | 1/8 | 300–500 | −325 $Fe_3O_4$ (25), −30 + 325 $Fe_3O_4$ (25), −325 Silica (25), −20 + Sand (25) | Sodium silicate |
| 10 | 72 | 1/8 | 200–300 | −325 $Fe_3O_4$ (12.5) −30 + 325 $Fe_3O_4$ (12.5) −325 Silica (37.5), −20 + 100 Sand (37.5) | Sodium silicate |
| 11 | 58 | 1/16 | 300–600 | −325 $Fe_3O_4$ (50), −20 + 100 Sand (50) | Sodium silicate |

*a nickel, zinc ferrite having a resistivity of about $10^8$ ohm/centimeters made by the Indiana General Corporation of Indiana.

The food can be safely eaten directly from the package with little danger or burning the mouth or fingers since the heat absorbing member cools by the time the food is eaten to the temperature of the food before the food is eaten. For the purposes of the present invention, it is assumed that the food is eaten about 30 seconds or more from the time that the oven is turned off.

The packages of the invention can also be sold empty for the consumer to use in heating any food product in the home and can be disposed of after use or used repeatedly as desired. In such an application of the invention the packages can be marked with the use intended, e.g., for heating pizza pie, for steaks, hamburgers, etc., for toasting sandwiches, for fruit pies, etc. In each case the thickness and composition of the heat absorbing layer 46 and the size of the openings in the shield, if any, would be the best for the particular food marked on the label.

It can also be seen that the heating body or composite 42 has the following important attributes. First, it heats quickly to a temperature that will brown or scorch the surface of the food. Second, in a preferred form of the invention it reaches a maximum temperature within the safe temperature zone for the food being heated if left too long in the oven, and third, it cools fast so as to reach the temperature of the food product by the time the food is eaten. In the case of a ferrous heating layer formed from particles held together with a binder it was found that the preferred thickness range for layer 46 is between about 0.02 and 0.187 inches. When thinner than this range, the absorber does not get hot enough nor heat fast enough for most foods. When above this range, the microwave energy absorber tends to heat too slowly, eventually reaches an unsafe temperature and retains heat too long for safety.

It will also be seen that each of the packages described has a space therein to receive a food product and the shield whether a separate piece as 38 and 76 or laminated to the microwave energy absorber as in FIG. 8 at least partially encloses the space for the food to partially or completely shield it from microwave energy. The heating body 42 is located adjacent to and defines one or more boundaries of the space for the food.

What is claimed is:

1. A food heating package adapted to contain a food product comprising a package body formed from microwave transparent non-lossy dielectric sheet material having a cellulosic or plastic resinous base defining a container body and a lossy microwave absorptive heating body connected to the package and associated in heat conductive relationship with said food, said heating body being in sheet form and the thickness of said sheet being at least about 0.016 inch thick and being substantially within the range wherein the sheet thickness and the temperature response during microwave heating are positively correlated, said sheet being of the minimum thickness that will reach but not exceed a preselected equilibrium operating temperature, a metal sheet in overlying relation to one side of and adjacent to the heating body, said heating body being characterized by heating when exposed to microwave radiation within a microwave oven to a sufficient temperature to sear, brown or crisp the food and cooling in 30 seconds or less after the oven is turned off to the temperature of the food whereby the package can be used as a dish from which the food can be directly eaten without burning the fingers.

2. A food heating package adapted to contain a food product comprising a package body formed from microwave transparent non-lossy dielectric sheet material having a cellulosic or plastic resinous base defining a container body and a lossy microwave adsorptive heating body connected to the package and associated in heat conductive relationship with said food, said heating body being in sheet form and the thickness of said sheet being substantially within the range wherein the sheet thickness and the temperature response during microwave heating are positively correlated, said sheet being of a paint-like layer applied to a metal support structure in sheet form and being bonded thereto on at least one surface thereof, the paint-like layer of adsorptive material being on the order of about 0.016" thick or more and said sheet and support structure being flexible, said heating body being characterized by heating when exposed to microwave radiation within a microwave oven to a sufficient temperature to sear, brown or crisp the food and cooling in 30 seconds or less after the oven is turned off to the temperature of the food whereby the package can be used as a dish from which the food can be directly eaten without burning the fingers.

3. A food heating package adapted to contain a food product comprising a package body formed from microwave transparent non-lossy dielectric sheet material having a cellulosic or plastic resinous base defining a container body and a lossy microwave absorptive heating body connected to the package and associated in heat conductive relationship with said food, said heating body being in sheet form and the thickness of said sheet being at least about 0.016" thick and being substantially within the range wherein the sheet thickness and the temperature response during microwave heating are positively correlated, the heating body comprising a multiplicity of particles of microwave absorptive material of different particle sizes and a binder bonding said particles together, a metal sheet in overlying relation to one side of and adjacent to the heating body, said heating body being characterized by heating when exposed to microwave radiation within a microwave oven to a sufficient temperature to sear, brown or crisp the food and cooling in 30 seconds or less after the oven is turned off to the temperature of the food whereby the package can be used as a dish from which the food can be directly eaten without burning the fingers.

4. The package of claim 3 wherein at least some of the microwave absorptive particles are iron oxide and the binder is a mineral.

5. The package of claim 3 wherein the microwave absorptive material comprises $Fe_3O_4$ and said binder is sodium silicate.

6. The package of claim 5 wherein a microwave transparent mineral is mixed with the $Fe_3O_4$ as a diluent.

7. The package of claim 3 wherein the heating body is between about 0.016 and about 0.187 inches in thickness.

8. The food heating package of claim 4 wherein a microwave transparent material in solid particulate form is mixed with the particles of iron oxide.

9. The package of claim 3 wherein the microwave absorber sheet is of the minimum thickness that will reach but not exceed a preselected equilibrium operating temperature.

10. A disposable microwave food heating package adapted to contain a food product comprising an outer container body formed from paperboard, a lossy microwave absorptive heating element comprising a composite sheet mounted within the container, said composite sheet comprising an upper layer of a metal foil and a lower paint-like layer comprising a microwave absorptive substance in particulate form and a binder bonding the particles together and maintaining the absorptive layer in contact with the metal sheet, said paint-like layer being at least about 0.016" thick and being substantially within the range wherein the layer thickness and the temperature response during microwave heating are positively correlated, said container body having a top wall and a microwave opaque shield member comprising an electrically conductive metal sheet bonded to the top wall, said shield at least partially surrounding when the food is placed within the package to provide a predetermined controlled amount of direct microwave energy transmission into the food in an amount less than that which would be received by the food without the shield, whereby the food is simultaneously heated by the dual effect of controlled microwave radiation heating and by conduction from the composite sheet.

11. The package of claim 10 wherein the absorptive substance comprises $Fe_3O_4$ in particulate form and an inert mineral filler and said paint-like layer is between about 0.02 inch to 0.187 inch in thickness.

12. The package according to claim 10 wherein the lossy substance comprises $Fe_3O_4$ with an inert mineral filler and the binder comprises sodium silicate.

* * * * *